US007942105B1

(12) United States Patent
Dolton

(10) Patent No.: US 7,942,105 B1
(45) Date of Patent: May 17, 2011

(54) FOOT OPERATED SCUPPER PLUG

(75) Inventor: John A Dolton, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 371 days.

(21) Appl. No.: 12/243,548

(22) Filed: Oct. 1, 2008

(51) Int. Cl.
*B63B 13/00* (2006.01)

(52) U.S. Cl. ..... 114/197

(58) Field of Classification Search ..... 114/197, 114/182, 227, 228, 180, 210, 381; 220/238; 24/68 T, 68 CD
See application file for complete search history.

(56) References Cited

U.S. PATENT DOCUMENTS

| | | | | |
|---|---|---|---|---|
| 2,204,400 A | | 6/1940 | Brooks | |
| 2,321,515 A | * | 6/1943 | Rice | 114/227 |
| 4,930,657 A | * | 6/1990 | Walker | 220/235 |
| 4,993,246 A | | 2/1991 | Kopper | |

* cited by examiner

*Primary Examiner* — Ed Swinehart
(74) *Attorney, Agent, or Firm* — Kyle Eppele; Peter A. Lipovsky; Stephen E. Baldwin

(57) ABSTRACT

A scupper plug apparatus is foot-operable, by a person standing next to the scupper, to apply substantially more force for sealing the scupper than is typically achievable through application of force by the hand or arm of a person installing a scupper plug. A resilient body of the scupper plug formed from highly conformable closed-cell foam to closely match the shape of the scupper. A rolling member is used as a cam follower in an actuation arrangement for compressing the resilient body.

12 Claims, 6 Drawing Sheets

FOOT OPERATED SCUPPER PLUG

FEDERALLY-SPONSORED RESEARCH AND DEVELOPMENT

This invention (Navy Case No. 97,901) is assigned to the United States Government and is available for licensing for commercial purposes. Licensing and technical inquires may be directed to the Office of Research and Technical Applications, Space and Naval Warfare Systems Center, San Diego, Code 2112, San Diego, Calif. 92152; voice (619) 553-2778; email T2@spawar.navy.mil.

BACKGROUND OF THE INVENTION

Large ships, such as military fleet oilers, often have vertical coamings or bulwarks extending upward from the intersection of the deck and the hull of the ship, which in some cases extend upward from the deck to waist-height of a person standing on the deck. Such coamings and bulwarks typically include a plurality of openings, known as deck drains or "scuppers" at deck level, to permit controlled drainage overboard of water landing on the deck from waves while the ship is at sea, or from rainfall while the ship is at sea or in port. Such scuppers may take a variety of shapes including rectangular, round, half-round or ovoid, as is known in the art.

To protect the marine environment from pollution, it is sometimes necessary to temporarily seal the scuppers in a manner which prevents oily deck water from draining overboard. For example, in some ports, oil tankers tied next to a pier are required to retain all rainwater falling on the deck during fueling operations. To comply with such regulations, the scuppers draining deck water must be temporarily blocked in a manner allowing the rainwater to be collected from the deck in a controlled manner.

In the past, two primary approaches were utilized for temporarily sealing scuppers for containing deck water. In the first approach, standard-shaped, commercially available, rubber plugs having a general shape somewhat similar to the scupper opening in which they were to be used were compressed using a compression apparatus including two metal plates disposed on either end of the plug and a center bolt passing through the plugged end metal plates and secured by one or more wing nuts on threaded portions at one or both ends of the center bolt. The intent was that, as the wing nuts were tightened, the rubber plug would be compressed enough to conform to, and seal the scupper opening. Experience has shown, however, that the rubber used in standard size and shaped rubber plugs is too hard to adequately seal to the irregular surfaces found on shipboard scuppers and drains. This problem is exacerbated by the wing nuts not providing adequate leverage to sufficiently compress the rubber between the end plates.

In the second previously-used approach, wood blocks are temporarily cemented in place over the scuppers or deck drains using a type of adhesive or mortar. Although this method achieves a complete seal of the scupper, it is a highly labor-intensive process to install and remove the wood blocks, and often results in damage to the paint or protective coatings on the scuppers and adjacent surfaces.

An additional disadvantage of the prior approaches to temporarily blocking scuppers, is that both previously-used approaches required a considerable amount of bending over or kneeling down on the steel deck of the ship to install and remove the plugs.

It is desirable, therefore, to provide a new and improved apparatus and method for temporarily blocking a scupper or deck drain on a ship, in a manner which overcomes one or more of the disadvantages described above, or providing other advantages as will be recognized by those skilled in the art.

BRIEF SUMMARY OF THE INVENTION

The invention provides a new and improved method and apparatus for temporarily blocking a scupper opening on a ship through use of a scupper plug apparatus having an actuating arrangement which is capable of providing significantly more clamping force to a resilient body of the plug than was achievable in previously utilized approaches to temporarily blocking scupper openings. In some forms of the invention, the scupper plug apparatus is foot-operable, by a person standing next to the scupper, to thereby allow for application of substantially more force to an actuation lever of the scupper plug apparatus than is typically achievable through application of force by the hand or arm of a person installing a scupper plug. In some forms of the invention, the resilient body is composed of a closed-cell foam material which is more conformable to the shape of the scupper opening than the materials used in prior scupper plug approaches. In some forms of the invention, the resilient body is also molded to closely match the shape of a known scupper profile, when the resilient body is in a relaxed state, to thereby provide improved sealing between the resilient body and the scupper opening when the resilient body is compressed by an actuation apparatus in such a manner that an outer periphery of the resilient body expands into sealing contact with the scupper opening. Embodiments of the invention may also include a cam follower in the form of a rolling member to facilitate operation of an actuation arrangement used for compressing the resilient body.

These and other advantages of the invention, as well as additional inventive features, will be apparent from the description of the invention provided herein.

BRIEF DESCRIPTION OF THE DRAWINGS

The accompanying drawings incorporated in and forming a part of the specification illustrate several aspects of the present invention and, together with the description, serve to explain the principles of the invention. In the drawings, where like numbers illustrate like components.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE EMBODIMENTS

Figure 1:
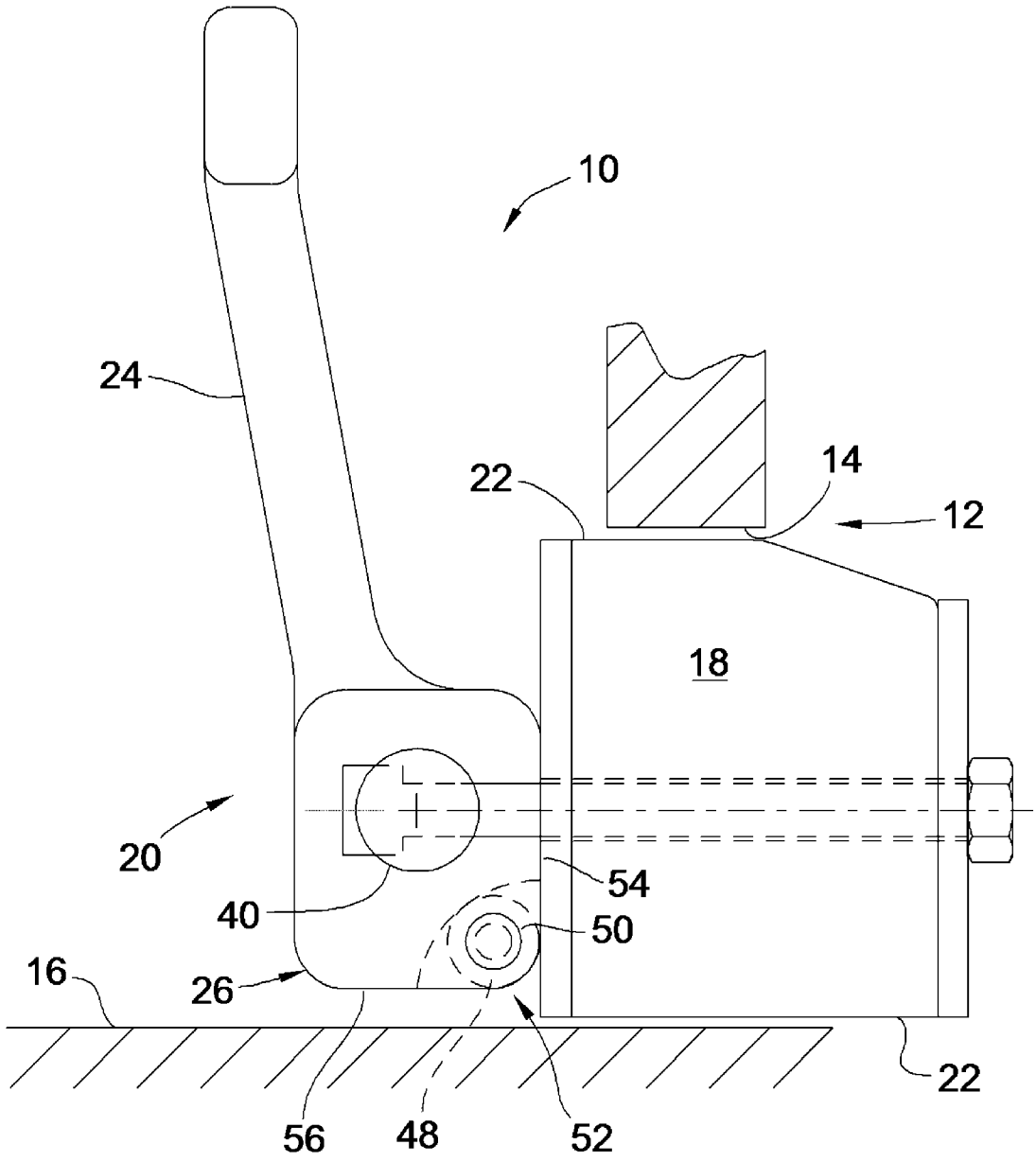
FIGS. 1 and 2 are a side view and a front view, respectively, of an exemplary embodiment of a locking, foot-operated scupper plug, according to the invention, for use in a rectangular-shaped scupper opening.
Figure 2:
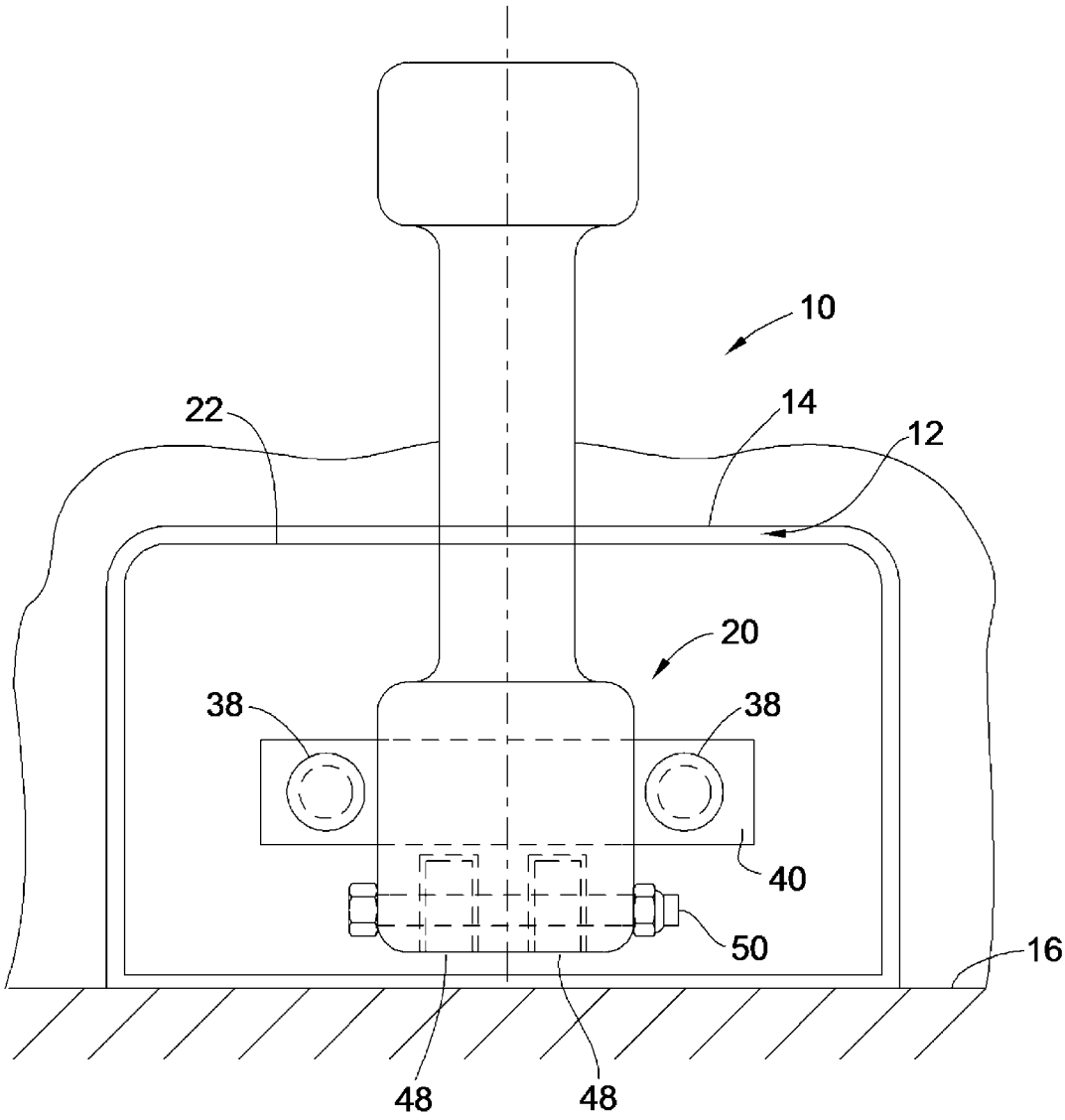

FIGS. 1 and 2 show a first exemplary embodiment of a foot-operable scupper plug 10, for blocking a scupper opening 12 on a ship, where the scupper has a scupper wall 14 defining a rectangular scupper shape, in combination with a deck 16 of the ship.

The first exemplary embodiment of the foot-operable scupper plug 10 includes a resilient body 18 and a foot-operable actuating arrangement 20.

Figure 3:
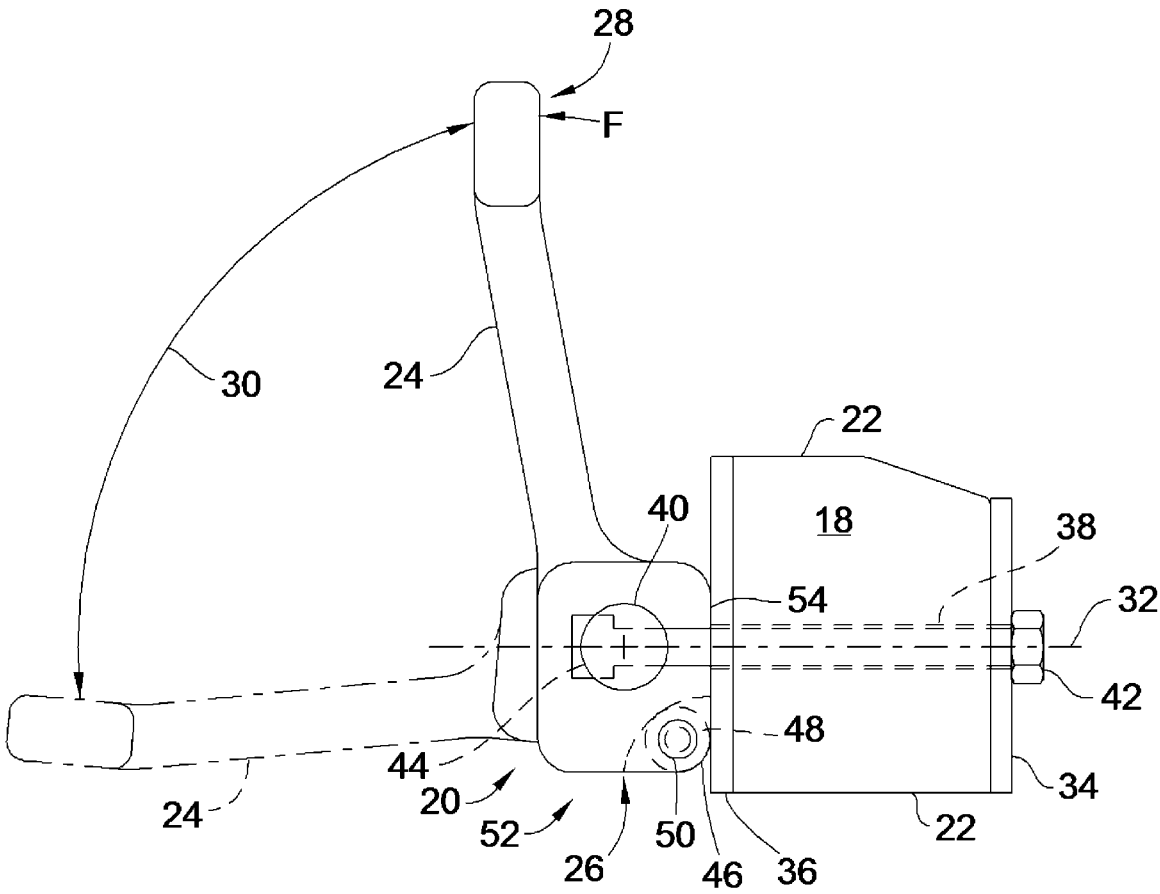
FIGS. 3 and 4 are side views of the exemplary embodiment of the foot-operated scupper plug shown in FIGS. 1 and 2, with FIG. 3 showing the scupper plug in an unlocked position thereof with a resilient body of the scupper plug in a relaxed position, and FIG. 4 showing the foot-operated scupper plug in a locked position thereof with the resilient body in an expanded position thereof.

The resilient body 18 has a periphery 22 thereof, which substantially matches the scupper shape, and is adapted for insertion into the scupper opening 12, when the resilient body 18 is in a relaxed state thereof, as shown in FIGS. 1 and 3.

Figure 4:
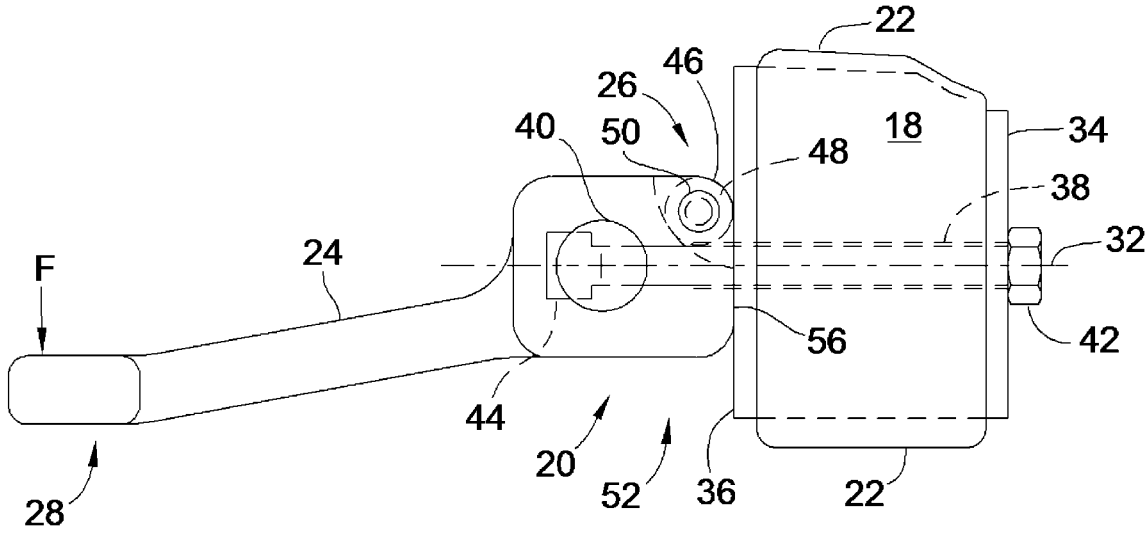

The foot-operable actuating arrangement 20 is operatively mounted on and connected to the resilient body 18, in a manner described in more detail below, for compressing the resilient body 18 in a manner urging at least a portion of the outer periphery 22 of the resilient body 18 to expand outward in an expanded state, as shown in FIG. 4. As the resilient body 18 is expanded outward, it comes into operative sealed engagement with the scupper wall 14, when the resilient body 18 is disposed within the scupper opening 12 with the resilient body 18 in the expanded state illustrated in FIG. 4.

In preferred embodiments of the invention, the resilient body 18 is configured to have a periphery 22 which closely matches the scupper opening 12, in the manner shown in FIGS. 1 and 2, such that the resilient body 18 need only expand enough to close a small gap remaining between the periphery 22 and the scupper wall 14 or the deck 16. In addition, it is contemplated that the resilient body be fabricated from a material such as a closed cell neoprene foam, having a durometer of zero, or an equivalent material, which is capable of readily expanding into and conforming to the shape of the scupper opening 12, to thereby provide a tight seal. It is contemplated that other appropriate types of foam or solid elastomers may also be used for forming the resilient body, such as, but not limited to, buna-N, Viton, and polyurethane.

As shown in FIGS. 3 and 4, the foot-operable actuating arrangement 20, in the first exemplary embodiment of the foot-operable scupper plug 10, includes a foot-operable lever 24, having proximal and distal ends 26, 28 thereof. The proximal end 26 of the foot-operable lever 24 is mounted to the resilient body 18 in a manner described in more detail below. The distal end 28 of the foot-operable lever 24 is configured for selective application thereto of an actuating force F, which can be applied by the foot of a person standing on the deck 16 near the scupper opening 12.

As shown in FIG. 3, the distal end 28 of the foot-operable lever 24 is selectively moveable through an arc 30 about the proximal end 26 of the foot-operable lever 24, between a first position thereof, as shown in solid lines in FIG. 3, whereat the resilient body 18 is in the relaxed state, and a second position thereof, as shown in dashed lines in FIG. 3, whereat the resilient body 18 is in the expanded state thereof as shown in FIG. 4.

As shown in FIGS. 3 and 4, the resilient body 18 defines a compression axis 32 thereof, with the periphery 22 of the body 18 being disposed substantially radially about the compression axis 32.

The actuation arrangement 20 is configured and operatively attached to the resilient body 18 in such a manner that movement of the foot-operable lever 24 from the first position toward the second position thereof, as illustrated in FIG. 3, causes the actuation arrangement 20 to compress the resilient body 18 in a direction parallel to the compression axis 32. The resulting compression of the resilient body 18 along the compression axis 32 causes the periphery 22 of the resilient body to expand substantially radially from the compression axis.

The actuation arrangement 20 further includes first and second compression plates 34, 36 a pair of tension members in the form of tie bolts 38 (as shown in FIGS. 3, 4 and 2), and a pivot pin 40.

The first and second compression plates 34, 36 are disposed respectively at first and second axial ends of the resilient body 18. The tie bolts extend from the first compression plate 34, substantially parallel to the compression axis 32, and successively through the resilient body 18 and the second compression plate 36. The tie bolts 38 have first and second axial ends 42, 44 thereof, with the first axial end 42 of the tie bolts 38 being operatively attached to the first compression plate 32, for urging movement of the first compression plate 34 along the compression axis 32 toward the second compression plate 36 when the tie bolts 38 are placed into tension.

The pivot pin 40 is slidingly disposed in a bore extending transversely through the proximal end 26 of the foot-operated lever 24, as shown in FIGS. 1-4, and operatively connected to the second ends 44 of the tie bolts 38, for exerting a pulling force on the second ends 44 of the tie bolts 38, as the foot-operable lever 24 is moved form the first position toward the second position thereof, and conversely, for relieving the pulling force as the foot-operable lever 24 is moved from the second position toward the first position.

The proximal end 26 of the foot-operable lever 24 defines a cam surface 46 thereof, configured to bear against the outer surface of the second compression plate 36 opposite from the resilient body 18, in such a manner that tension in the tie bolts 38 is transferred to the second compression plate 36 as a corresponding compressive force by the cam surface 46 of the proximal end 26 of the foot-operable lever 24, to thereby urge compression of the resilient body 18 between the first and second compression plates 34, 36 along the compression axis 32.

In the first exemplary embodiment of the foot-operable scupper plug 10, according to the invention, the cam surface 46 of the proximal end 26 of the foot-operable lever 24 is partially defined by the outer surfaces of a pair of rolling elements, in the form of a pair of ball bearings 48 journalled about a bearing shaft 50 extending transversely through the proximal end 26 of the foot-operable lever 24. The bearing shaft 50 and bearings 48 are configured and disposed such that an outer surfaces of the bearings 48 provide rolling contact along the second compression plate 36 as the foot-operable lever 24 is moved between the first and the second positions thereof. Those having skill in the art will readily recognize that this arrangement substantially reduces frictional forces which would otherwise be encountered in moving the foot-operable lever 24 between the first to the second positions thereof. It will be further recognized, however, that in other embodiments of the invention, other types of friction-reducing arrangements may be utilized along the cam surface 46 to facilitate operation of the foot-operable lever 24. It will also be recognized, that in some embodiments no friction-reducing element will be provided along the cam surface 46, while still remaining within the scope of the invention as disclosed herein.

The actuating arrangement 20, for the first exemplary embodiment of the invention 10 further includes an over-center locking arrangement 52, for locking the foot-operable lever 24 in a locked position corresponding to the second position of the lever. The locking arrangement 52 in the exemplary embodiment 10 of the invention is achieved by configuring the proximal end 26 of the foot-operable lever to include first and second flat surfaces 54, 56 on either side of the bearings 48, as shown in FIG. 1, in such a manner that the first and second positions of the foot-operable lever 24 respectively correspond to an unlocked position and a locked position of the foot-operable lever 24. Stated another way, the first flat surface 54 bears against the second compression plate 36, in the manner shown in FIGS. 1 and 3, to preclude movement of the foot-operable lever 24 along the arc 30, when the lever 24 is in the unlocked position shown in FIG. 3. In similar fashion, the second flat surface 56 prevents the foot-operable lever 24 from being moved out of the locked position due to forces being generated on the actuation apparatus 20 by the resilient body 18.

Figure 5:
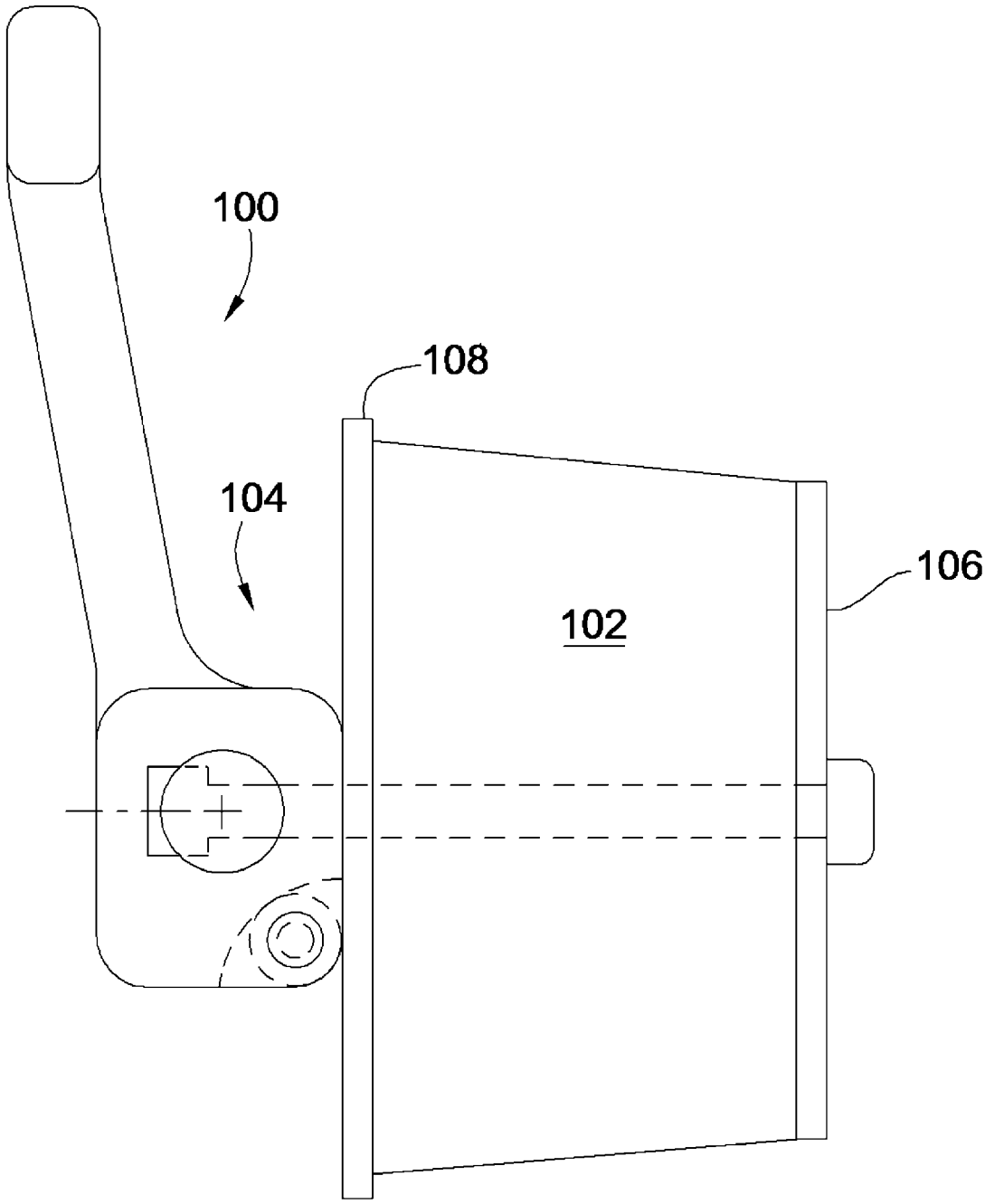
FIGS. 5 and 6 are a side view and a front view, respectively, of a second exemplary embodiment of a foot-operated scupper plug, according to the invention, for use in a round scupper opening, rather than the rectangular scupper opening shown in FIGS. 1-4.
Figure 6:
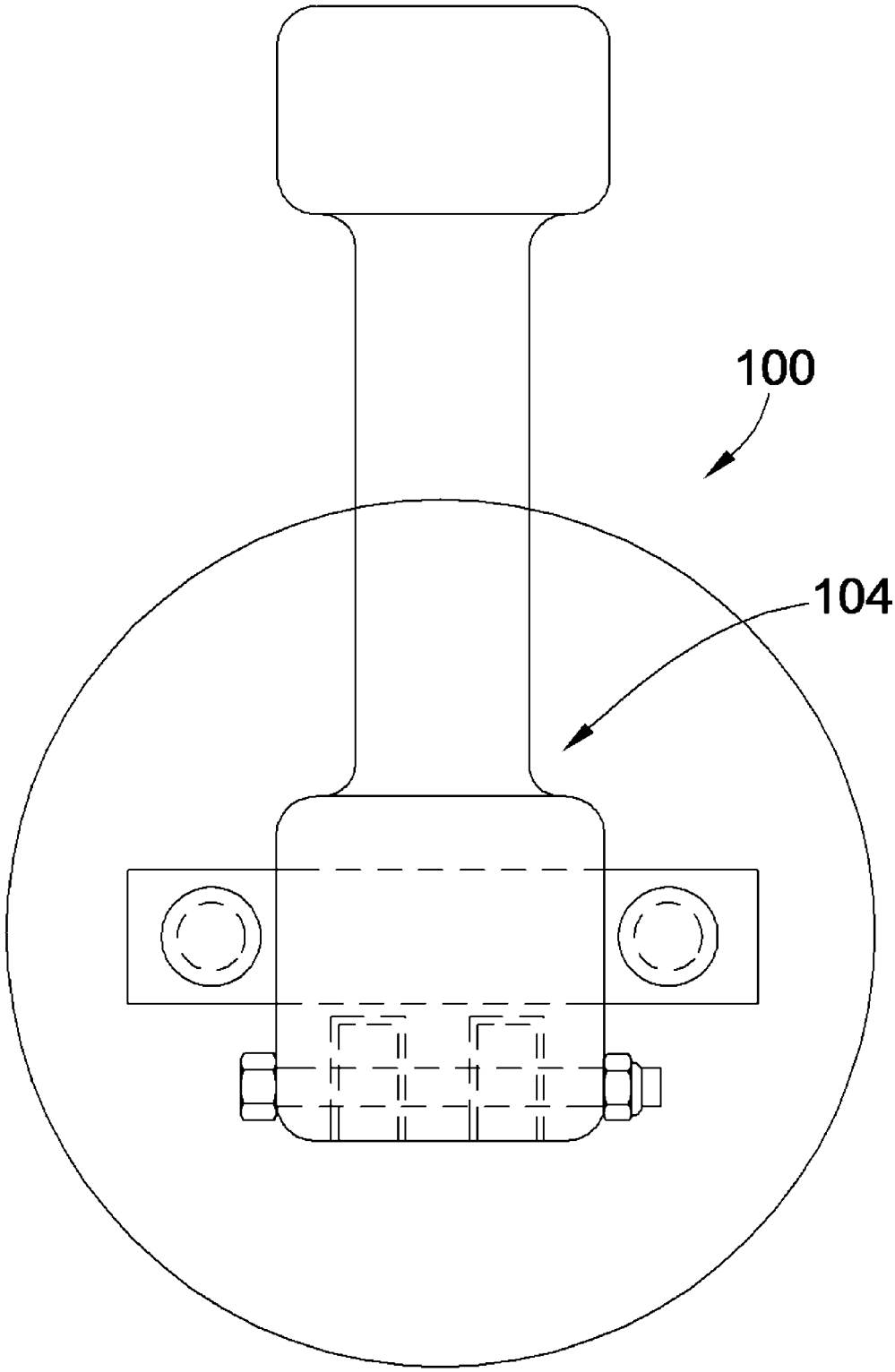

FIGS. 5 and 6 show a second exemplary embodiment of a foot-operable scupper plug 100, according to the invention, which includes a resilient body 102, and a foot-operable actuating apparatus 104. In general, the foot-operable actuating arrangement 104 of the second exemplary embodiment 20 is substantially identical in construction and operation to the foot-operable actuating arrangement 20 of the first exemplary embodiment 10. The first and second compression plates 106, 108, and the resilient body 102 of the second embodiment 100 are configured to fit into and be used with a scupper opening having a round shape, rather than the rectangular-shaped scupper opening 12 illustrated and described above with regard to the first exemplary embodiment 10 with reference to FIGS. 1-4. It will be understood, that, in various embodiments of the invention, the first and second compression plates and resilient body of a scupper plug in accordance with the invention will generally be shaped to conform closely to the shape of the scupper opening in which they are intended to be used.

It is contemplated that the resilient body 20, 102, in a scupper plug apparatus or method, according to the invention, will preferably be molded into the desired shape, so as to provide only a small clearance between the periphery of the resilient body and the scupper opening in which it is to be used. By virtue of this arrangement, the amount of actuating force which must be applied to obtain a tight seal between the periphery of the resilient body and the scupper opening is substantially reduced, as compared to prior apparatuses and methods. In addition, as previously stated, it is contemplated that low durometer materials may be used for forming the resilient bodies in scupper plug apparatuses, according to the invention, to further reduce the amount of compression force required, and to provide for substantially improved conformability of the periphery of the resilient body to the scupper opening than was achievable with prior methods and apparatuses.

In some forms of the invention, the length of tie bolts 38, or other tensioning members in accordance with the invention, may be threadably adjustable to thereby allow for some degree of adjustment of the compressive force exerted, and expansion of the outer periphery of the resilient member. It will also be noted that, by virtue of this arrangement, the resilient body may be replaced when damaged or worn, by unthreading the tension member in such a manner that the resilient body may be removed and replaced. It is also contemplated, that in some embodiments of the invention, a single actuating arrangement may be supplied in a kit with a variety of different size and shape resilient bodies and matching first and second compression plates, which can be alternately attached to the remainder of the actuation arrangement to match the shape of the resilient member to a variety of different scupper shapes.

It will also be understood, that although the exemplary embodiment discussed herein have all been foot-operable, it is contemplated that the invention may be practiced in forms which are not adapted to be foot-operable, or in applications where the actuating force is applied to a foot-operable apparatus, according to the invention, by hand, or in some manner other than through pressure from the foot of a person standing next to the scupper.

It is also noted that, although the exemplary embodiment disclosed herein had the actuating lever extending substantially transverse to the compression axis, when the resilient body is in its relaxed state, and extending more or less parallel to the compression axis when the resilient body is in its extended state, in other embodiments of the invention, the actuating arrangement may be reconfigured to operate substantially oppositely, within the teachings of the invention, such that the actuating lever would extend substantially parallel to the compression axis when the resilient body is in a relaxed state, and substantially perpendicular to the compression axis when the resilient body is in the expanded state. Such an arrangement might be preferable, for instance, in applications such as closing scuppers in the hull of a ship, where it would be desirable to have the actuating arrangement work substantially opposite from the exemplary embodiments disclosed herein, such that the actuating lever would extend perpendicular to the hull when the resilient body was in the relaxed state and parallel to the hull when the resilient body was in its extended state.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

It will be understood that many additional changes in the details, materials, steps and arrangement of parts, which have been herein described and illustrated to explain the nature of the invention, may be made by those skilled in the art within the principal and scope of the invention as expressed in the appended claims.

What is claimed is:

1. A foot-operable scupper plug (FOSP), for blocking a scupper opening of a ship, wherein the scupper has a scupper wall defining a scupper shape, the FOSP comprising:

a resilient body having a periphery thereof substantially matching the scupper shape and adapted for insertion in to the scupper opening in a relaxed state of the resilient body; and a foot-operable actuating arrangement operatively mounted on and connected to the resilient body for compressing the resilient body in a manner urging at least a portion of the outer periphery of the resilient body to expand outward in an expanded state, and into operative engagement with the scupper wall when the resilient body is disposed within the scupper opening with the resilient body in the expanded state, wherein, the foot-operable actuating arrangement comprises a foot-operable lever having proximal and distal ends thereof, the proximal end being mounted to the resilient body and the distal end being configured for actuation by the foot of a person standing near the scupper, the distal end of the foot operable lever being selectively movable through an arc about the proximal end of the foot-operable lever between a first position thereof whereat the resilient body is in the relaxed state and a second position thereof whereat the resilient body is in the expanded state thereof, the resilient body defines a compression axis thereof, with the periphery of the body being disposed substantially radially about the compression axis; and the foot-operable actuation arrangement is configured and operatively attached to the resilient body in such a manner that movement of the foot-operable lever from the first position toward the second positions thereof causes the foot-operable actuation arrangement to compress the resilient body in a direction parallel to the compression axis, with compression of the resilient body along the compression axis resulting in expansion of the periphery of the resilient body in a direction substantially radial to the compression axis, and wherein, the resilient body defines first and second axial ends thereof extending transversely to the compression axis, and the foot-operable actuation arrangement further comprises:

first and second transversely extending compression plates disposed respectively at the first and second axial ends of the resilient body;

at least one tension member extending from the first compression plate substantially parallel to the compression axis successively through the resilient body and the second compression plate, with the tension member having first and second axial ends thereof, with the first axial end thereof being operatively attached to the first compression plate for urging movement of the first compression plate toward the second compression plate along the compression axis toward the second compression plate when the tension member is placed into tension; and a pivot pin extending pivotably through the proximal end of the foot-operable lever and operatively connected to the second end of the tension member for exerting a pulling force on the second end of the tension member as the foot-operable lever is moved from the first position toward the second position thereof, and for relieving the pulling force as the foot-operable lever is moved from the second position toward the first position;

with the proximal end of the foot-operable lever defining a cam surface thereof configured to bear against the second compression plate opposite from the resilient body, in such a manner that tension in the tension member is transferred to the second compression plate as a corresponding compressive force by the cam surface of the proximal end of the foot-operable lever, to thereby urge compression of the resilient body between the first and second compression plates along the compression axis wherein, the tension member passes through the first compression plate and the first end of the tension member is configured to bear against the first compression plate opposite the resilient body when the tension member is in tension.

2. The FOSP of claim 1, wherein, the resilient body is at least partially formed from a closed cell foam having a low durometer.

3. The FOSP of claim 1, wherein, the scupper opening is oriented substantially perpendicularly to a deck of the ship, such that, when the resilient body is disposed within the wall of scupper opening, the foot-operable lever is oriented substantially parallel to the deck when in the locked position and substantially perpendicular to the deck when the foot-operable lever is in the un-locked position thereof.

4. The FOSP of claim 1, wherein, the foot operable actuating arrangement includes a locking arrangement for locking the foot-operable lever in the locked position.

5. The FSOP of claim 1, wherein, the proximal end of the foot-operable lever is operatively joined to the resilient body by a snap-action arrangement comprising the locking arrangement.

6. The FOSP of claim 1, wherein, the foot operable actuating arrangement includes a locking arrangement for locking the foot-operable lever in the locked position.

7. The FOSP of claim 1, wherein, the tension member passes through the first compression plate and the first end of the tension member is configured to bear against the first compression plate opposite the resilient body when the tension member is in tension.

8. The FOSP of claim 1, wherein, the length of the tension member is threadably adjustable.

9. The FOSP of claim 1, wherein, the foot operable actuating arrangement includes a locking arrangement for locking the foot-operable lever in the locked position.

10. The FOSP of claim 9, wherein, the locking arrangement is provided by an over-center arrangement defined by the proximal end of the foot-operable lever, such that the first and second positions of the foot-operable lever respectively correspond to an unlocked position and a locked position of the foot-operable lever.

11. The FOSP of claim 10, wherein, the proximal end of the foot-operable lever includes a flat segment thereof which bears against the second compression plate in the locked position for holding the foot-operable lever in the locked position.

12. A foot-operable scupper plug (FOSP), for blocking a scupper opening on a ship, wherein the scupper has a scupper wall defining a scupper shape, the FOSP comprising:

a resilient body having a periphery thereof substantially matching the scupper shape and adapted for insertion in to the scupper opening in a relaxed state of the resilient body; and a foot-operable actuating arrangement operatively mounted on and connected to the resilient body for compressing the resilient body in a manner urging at least a portion of the outer periphery of the resilient body to expand outward in an expanded state, and into operative engagement with the scupper wall when the resilient body is disposed within the scupper opening with the resilient body in the expanded state;

the foot-operable actuating arrangement including a foot-operable lever having proximal and distal ends thereof, the proximal end being mounted to the resilient body and the distal end being configured for selective application thereto of an actuating force by the foot of a person standing near the scupper, the distal end of the foot-operable lever being selectively movable through an arc about the proximal end of the foot-operable lever between an unlocked position thereof whereat the resilient body is in the relaxed state and a locked position thereof whereat the resilient body is in the expanded state thereof;

the resilient body defining a compression axis thereof, with the periphery of the body being disposed substantially radially about the compression axis;

the foot-operable actuating arrangement being configured and operatively attached to the resilient body in such a manner that movement of the foot-operable lever from the unlocked position toward the locked position thereof causes the actuating arrangement to compress the resilient body in a direction parallel to the compression axis, with compression of the resilient body along the compression axis resulting in expansion of the periphery of the resilient body in a direction substantially radial to the compression axis;

the foot-operable actuating arrangement further including first and second compression plates, at least one tension member and a pivot pin;

the first and second compression plates being disposed respectively at first and second axial ends of the resilient body and extending transversely to the compression axis;

the at least one tension member extending from the first compression plate substantially parallel to the compression axis successively through the resilient body and the second compression plate, with the tension member having first and second axial ends thereof, with the first axial end thereof being operatively attached to the first compression plate for urging movement of the first compression plate along the compression axis toward the second compression plate when the tension member is placed into tension;

the pivot pin extending pivotably through the proximal end of the foot-operable lever and being operatively connected to the second end of the tension member for exerting a pulling force on the second end of the tension member, as the foot-operable lever is moved from the first position toward the second position thereof, and for relieving the pulling force as the foot-operable lever is moved from the second position toward the first position;

the proximal end of the foot-operable lever defining a cam surface thereof configured to bear against the second compression plate opposite from the resilient body, such that tension in the tension member is transferred to the second compression plate as a corresponding compressive force by the cam surface of the proximal end of the foot-operable lever, to thereby urge compression of the resilient body between the first and second compression plates along the compression axis;

the cam surface of the proximal end of the foot-operable lever being defined by a rolling element journaled to the proximal end of the foot-operable lever and disposed for rolling contact along the second compression plate as the foot-operable lever is moved between the first and second positions thereof;

the foot-operable actuating arrangement further including an over-center locking arrangement for locking the foot-operable lever in the locked position such that the first and second positions of the foot-operable lever respectively correspond to an unlocked position and a locked position of the foot-operable lever;

the locking arrangement being at least partially provided by configuring proximal end of the foot-operable lever to include a flat segment thereof which bears against the second compression plate in the locked position for holding the foot-operable lever in the locked position.

* * * * *